US010619425B2

(12) United States Patent
Maenza et al.

(10) Patent No.: US 10,619,425 B2
(45) Date of Patent: Apr. 14, 2020

(54) PACKER RETRIEVAL EXTENSION FOR METAL TO METAL SEALING IN TENSION AND COMPRESSION

(71) Applicant: BAKER HUGHES, A GE COMPANY, LLC, Houston, TX (US)

(72) Inventors: Frank J. Maenza, Houston, TX (US); Christopher J. Limb, Cypress, TX (US); Stephen H. Bisset, Kingwood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 18 days.

(21) Appl. No.: 15/343,813

(22) Filed: Nov. 4, 2016

(65) Prior Publication Data

US 2018/0128059 A1 May 10, 2018

(51) Int. Cl.

| | |
|---|---|
| ***E21B 17/02*** | (2006.01) |
| ***E21B 17/04*** | (2006.01) |
| ***E21B 17/042*** | (2006.01) |

(52) U.S. Cl.

CPC ..... *E21B 17/0423* (2013.01); *E21B 17/02* (2013.01); *E21B 17/04* (2013.01)

(58) Field of Classification Search

CPC ..... E21B 17/02; E21B 17/04; E21B 17/042; E21B 17/0423; E21B 33/1212

See application file for complete search history.

(56) References Cited

U.S. PATENT DOCUMENTS

| | | | | | |
|---|---|---|---|---|---|
| 1,344,774 | A * | 6/1920 | Stafford | E21B 17/042 | 285/119 |
| 2,273,017 | A * | 2/1942 | Boynton | E21B 17/0423 | 285/288.5 |
| 3,054,450 | A * | 9/1962 | Baker, Jr. | E21B 33/1295 | 166/120 |
| 3,472,520 | A * | 10/1969 | Burns | E21B 33/1212 | 166/196 |
| 5,810,083 | A * | 9/1998 | Kilgore | E21B 34/10 | 166/120 |

* cited by examiner

*Primary Examiner* — Cathleen R Hutchins

(74) *Attorney, Agent, or Firm* — Shawn Hunter

(57) ABSTRACT

A production sting has a premium thread preferably VAM or similar for threading into a packer extension without the need for a seal stack to engage a seal bore in the extension. The seal bore use becomes optional and a metal to metal seal is provided by the premium thread whether the string is in compression or tension. Another adjacent left hand square thread is provided in the packer extension to land accessory tools or for removal of the packer after the packer is released in a variety of known ways. Either the premium thread or the left hand thread can be in the uphole position on the packer extension.

20 Claims, 5 Drawing Sheets

PACKER RETRIEVAL EXTENSION FOR METAL TO METAL SEALING IN TENSION AND COMPRESSION

FIELD OF THE INVENTION

The field of the invention is packer extensions and more particularly designs for such extensions that provide a threaded metal to metal seal in tension and compression while eliminating a traditional seal stack.

BACKGROUND OF THE INVENTION

Production strings are typically connected to a seal bore packer extension in a way that energizes a metal to metal seal at the lower end of a seal bore with opposed chevron seal stacks above the metal to metal seals that seal between the anchor sub and the balance of the seal bore. The connection is held together by a two-step threaded connection. One issue with this arrangement is that the two step thread has sufficient play axially such that if the production string is put into tension the metal seal may lose contact leaving only the chevron seal stack as the sole seal. This condition can create issues with regulations that require dual seals.

FIG. 1 illustrates this arrangement. Packer extension 10 has a seal bore 12. An anchor sub 14 has a metal to metal seal 16 and opposed chevron seal stacks 18. As a result of making up two-step thread 20 the metal seal 16 is energized and the seal stack 18 is against the seal bore 12. The issue with this design is that there is axial play in the two step thread 20 which combined with tension on the anchor sub 14 from the production string that supports it and is not shown has the result of undermining the metal to metal seal. This leaves the seal stack 18 as the sole operating seal and regulations or operator policies require dual seals for arrangements shown in FIG. 1.

The present invention represents a new take on dealing with this issue. The seal bore in the packer extension is made optional and the anchor sub is eliminated in favor of an external thread on the lower end of the production string that engages directly to the packer extension. The thread is preferably a VAM type premium thread, or similar premium or tapered thread meeting the performance criteria all being collectively referred to as premium thread, so that a metal to metal seal results and the seal stack is eliminated. The VAM thread is combined with a left handed square thread to engage a retrieval tool after the packer is released to relax for retrieval such as by breaking a shear member with a latching collet on a retrieval tool or simply cutting through the packer mandrel to release it. These and other aspects of the present invention will be more readily apparent from a review of the description of the preferred embodiment and the associated drawings while recognizing that the full scope of the invention is to be determined by the appended claims.

SUMMARY OF THE INVENTION

A production sting has a premium thread preferably VAM for threading into a packer extension without the need for a seal stack to engage a seal bore in the extension. The seal bore use becomes optional and a metal to metal seal is provided by the premium thread whether the string is in compression or tension. Another adjacent left hand square thread is provided in the packer extension for removal of the packer after the packer is released in a variety of known ways. Either the premium thread or the left hand thread can be in the uphole position on the packer extension.

DETAILED DESCRIPTION OF THE PREFERRED EMBODIMENT

Figure 1:
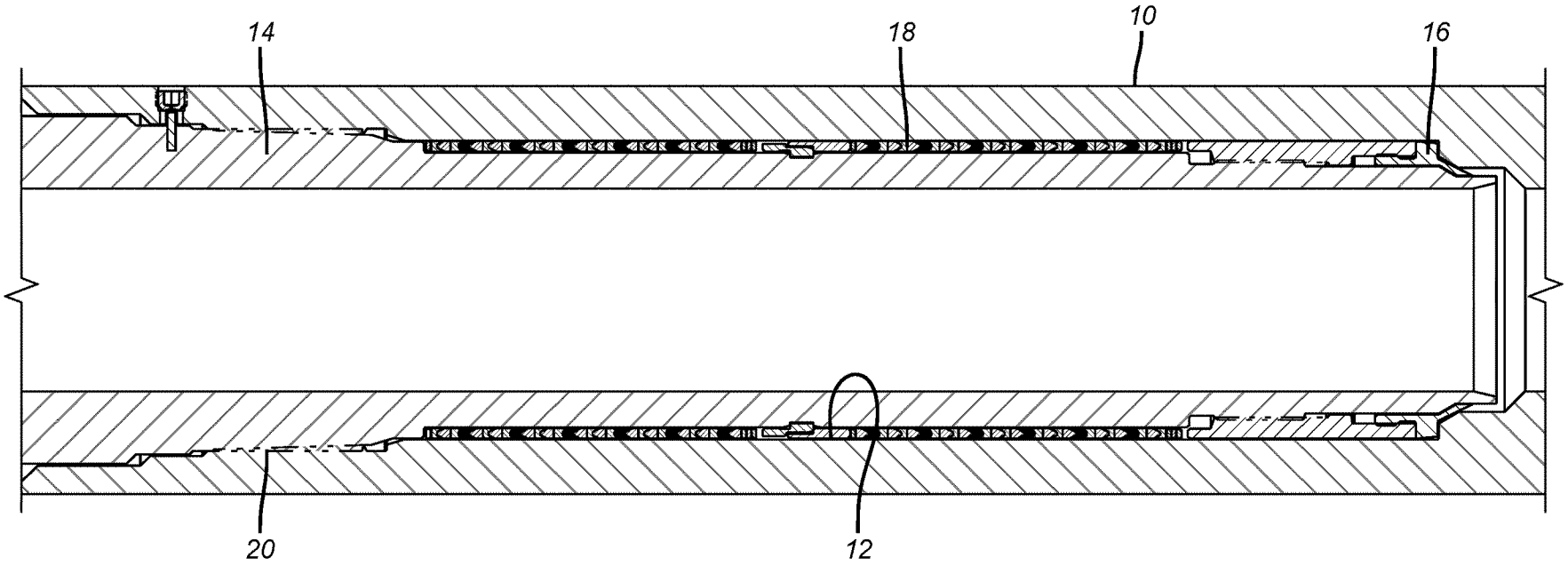
(PRIOR ART) FIG. 1
FIG. 1 is a prior art section view of an anchor sub with a metal seal and seal stack mounted to a seal bore in a packer extension.
Figure 2:
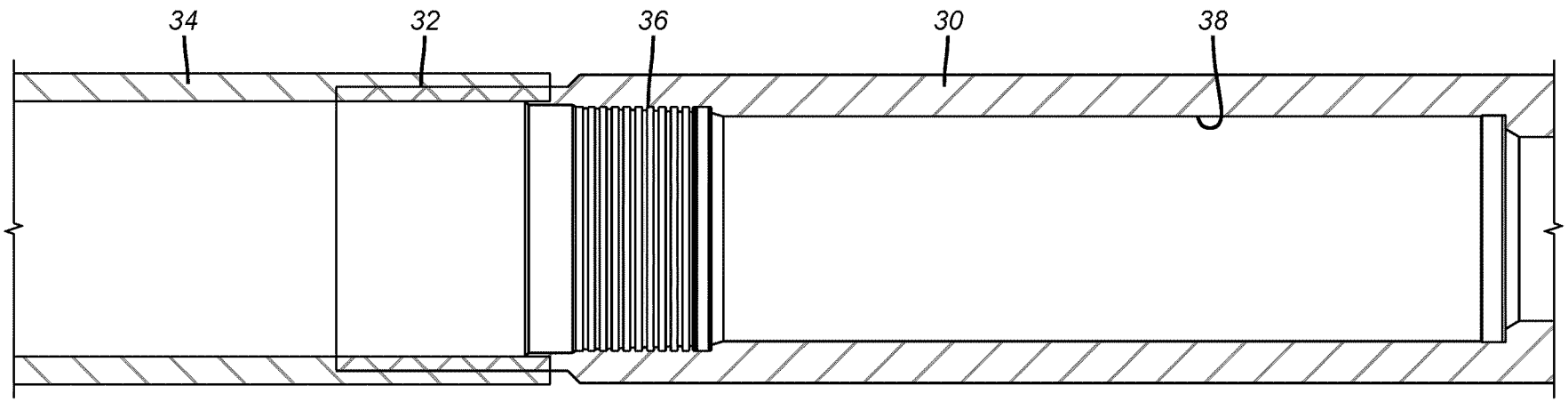
FIG. 2 shows the premium thread on the production string mated to an uphole position on the packer extension in a section view.

Referring to FIG. 2, the packer extension 30 has a premium thread understood to mean a thread pattern that provides metal to metal sealing capability in tension and compression such as a VAM 32 or alternatively a tapered thread that provides a metal to metal seal such as API EU or NU or similarly performing casing or tubing joint thread all referred to herein as "premium thread" to which the production string 34 is attached with a mating premium thread. A left hand square thread 36 is located downhole from premium thread 32 although the two threads can be switched as shown FIG. 3. Threads 32 and 36 can be together or spaced apart. Bore 38 in packer extension 30 can optionally be a polished seal bore although the need for a seal bore is simply for a backup potential of using the configuration of FIG. 1 in the extension 30. Putting the premium thread 32 at the uphole end as shown in FIG. 2 allows a seal bore, if used, to be as large as possible to accommodate the FIG. assembly if it needs to be used.

Figure 3:
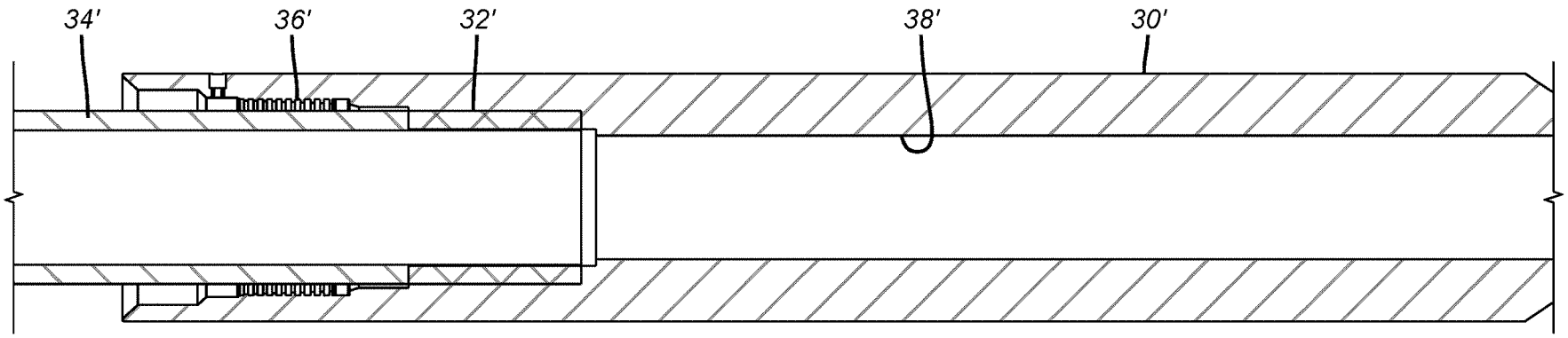
FIG. 3 shows the production string premium thread engaging a premium thread in a downhole location on the packer extension is a section view.

In FIG. 3 the positions of the premium thread 32' and the left hand thread 36' have been reversed compared to FIG. 2. As a result any seal bore 38', if used, would by definition have to be smaller than seal bore 38. Thus FIGS. 2 and 3 show alternative options to connect a production string 34 or 34' to a packer extension 30 or 30'.

Figure 4:
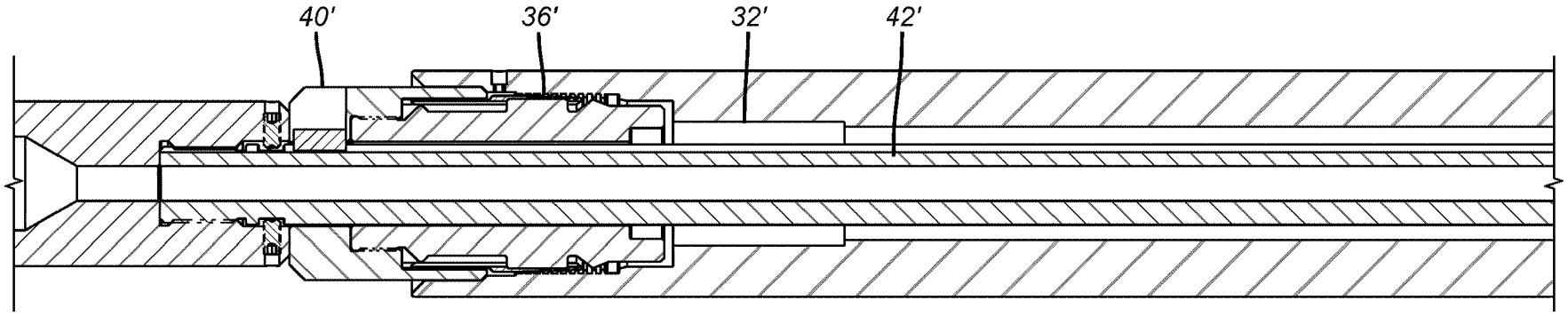
FIG. 4 is the view of FIG. 3 with the packer released and the release tool engaged to a left hand thread uphole of the premium thread for the production string.
Figure 5:
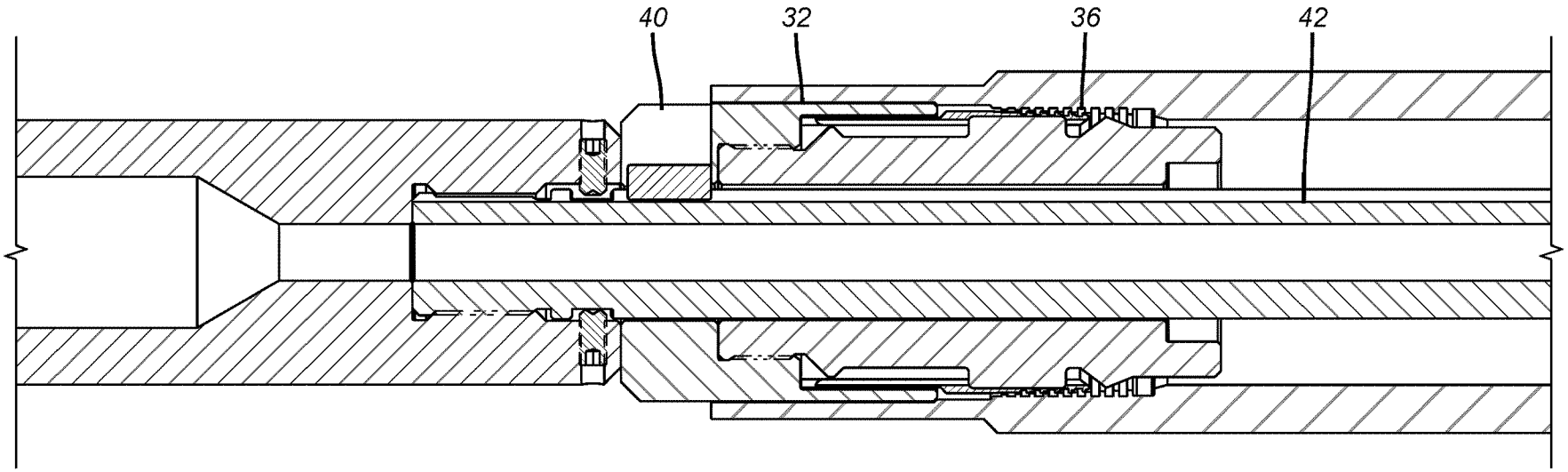
FIG. 5 is the view of FIG. 2 with the production string removed and the packer released with a release tool connected to a left hand thread located downhole from the premium thread for the production string.

If the packer that is not shown needs to be retrieved the production string 34 or 34' is removed and a retrieving tool of a known design is run in and threaded at 36 or 36' as in FIGS. 5 and 4 respectively. Extending tube 42 or 42' engage a packer release after the left hand thread 36 or 36' is made up. The packer release is thus mechanically accomplished in a known way. Alternatively the packer mandrel can be severed to release the packer also in a known way.

Those skilled in the art will appreciate the benefits offered by mounting a packer receptacle with dual threads above the packer. The production string can be secured to hold pressure with the string in tension or compression with a metal to metal seal that is always holding. A seal bore does not have to be machined and a seal stack that resides in a seal bore can also be eliminated. This creates dramatic cost savings and performance benefits to the FIG. 1 embodiment. Using the embodiment of FIGS. 2 and 5, a seal bore can still be provided should there be a need for the use of the FIG.

1 embodiment as a backup to the present invention. Known retrieval tools can be deployed into the left hand thread which can be engaged by a snap latch with setting down weight as shown in FIGS. 4 and 5.

The above description is illustrative of the preferred embodiment and many modifications may be made by those skilled in the art without departing from the invention whose scope is to be determined from the literal and equivalent scope of the claims below:

We claim:

1. A connection assembly for a packer, comprising:

a tubular connection member on a packer extension extending in a direction toward a surface end of the borehole, said tubular connection member further comprising a first thread for sealing engagement with a tubular string when a packer is attached to said packer extension and a second axially spaced thread accessible in the same bore of the same tubular connection member as said first thread for engagement of a retrieving tool after removal of the tubular string from engagement to said first thread to bring said packer to a surface location; and wherein the first thread is a right-handed thread, and the second thread is a left-handed thread.

2. The assembly of claim 1, wherein:

said first thread is a premium thread.

3. The assembly of claim 2, wherein:

said premium thread is a VAM type.

4. The assembly of claim 2, wherein:

said premium thread comprises a tapered thread.

5. The assembly of claim 1, wherein:

said first thread when made up between said tubular connection member and the tubular string provides a metal to metal seal under tension and compression.

6. The assembly of claim 1, wherein:

said second thread is a left hand square thread.

7. The assembly of claim 1, wherein:

said first thread is closer to a surface location on said tubular connection than said second thread with said first and second threads being adjacent or spaced apart.

8. The assembly of claim 7, wherein:

said tubular connection further comprises a seal bore located further from the surface of the borehole than said second thread.

9. The assembly of claim 1, wherein:

said second thread is closer to a surface location on said tubular connection than said first thread with said threads being adjacent or spaced apart.

10. The assembly of claim 1, wherein:

said packer selectively releasable by said retrieving tool.

11. A connection method for a tubular string to a tubular connection mounted above a borehole tool, comprising:

providing a first and second threads on said tubular connection, the first and second threads being located within the same bore of the tubular connection;

creating a metal to metal seal by connecting said tubular string at said first thread;

releasing and removing the tubular string from the first thread;

securing a release tool to the second thread by latching the release tool into the second thread; and releasing the borehole tool with a release tool connected to said second thread that radially retracts the borehole tool for removal from the borehole; wherein the first thread is a right-handed thread, and the second thread is a left-handed thread.

12. The method of claim 11, comprising:

making said first thread a premium thread.

13. The method of claim 12, comprising:

making said first thread a VAM type thread.

14. The method of claim 13, comprising:

maintaining said metal to metal seal at said VAM type premium thread when the tubular string is in tension or compression.

15. The method of claim 12, comprising:

making said second thread a left handed square thread.

16. The method of claim 15, comprising:

locating said premium thread uphole of said left handed square thread with said threads being adjacent or spaced apart.

17. The method of claim 15, comprising:

locating said premium thread downhole of said left handed square thread with said threads being adjacent or spaced apart.

18. The method of claim 15, comprising:

making the borehole tool a packer that is released with a release tool connected to said left handed square thread.

19. The method of claim 12, comprising:

making said premium thread a tapered thread.

20. The method of claim 11, comprising:

maintaining said metal to metal seal when the tubular string is in tension or compression.

* * * * *